US012071283B2

(12) United States Patent
Evans et al.

(10) Patent No.: US 12,071,283 B2
(45) **Date of Patent: *Aug. 27, 2024**

(54) FOOD STORAGE TRAY

(71) Applicant: Intercontinental Great Brands LLC, East Hanover, NJ (US)

(72) Inventors: Alicia Evans, Houston, TX (US); Patrick Harrell, Houston, TX (US); Mandar Madhukar Kulkarni, Houston, TX (US); Rafael Quinones, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/215,441

(22) Filed: Jun. 28, 2023

(65) Prior Publication Data

US 2023/0339649 A1 Oct. 26, 2023

Related U.S. Application Data

(63) Continuation of application No. 17/590,309, filed on Feb. 1, 2022, now Pat. No. 11,724,855, which is a (Continued)

(51) Int. Cl.

| | |
|---|---|
| ***B65D 1/36*** | (2006.01) |
| ***B65D 5/50*** | (2006.01) |
| ***B65D 85/36*** | (2006.01) |

(52) U.S. Cl.

CPC ..... *B65D 5/503* (2013.01); *B65D 1/36* (2013.01); *B65D 85/36* (2013.01)

(58) Field of Classification Search

CPC ..... B65D 5/503; B65D 1/36; B65D 85/36 (Continued)

(56) References Cited

U.S. PATENT DOCUMENTS

| | | | |
|---|---|---|---|
| 2,934,252 | A | 4/1960 | Wickstrom |
| D194,375 | S | 1/1963 | Malmgren |

(Continued)

FOREIGN PATENT DOCUMENTS

| | | |
|---|---|---|
| BE | 1018227 | 7/2010 |
| EP | 0881163 | 12/1998 |

(Continued)

OTHER PUBLICATIONS

International Search Report and Written Opinion, International Patent Application No. PCT/US2019/040079, date of mailing Sep. 24, 2019 (10 pgs.).

(Continued)

*Primary Examiner* — Anthony D Stashick
*Assistant Examiner* — L Kmet
(74) *Attorney, Agent, or Firm* — Fitch, Even, Tabin & Flannery LLP

(57) ABSTRACT

A tray is provided for retaining a plurality of food items that includes a bottom wall portion and a sidewall portion together defining a plurality of compartments separated from each other by dividers and each configured to retain a stack of the food items. Each of the dividers is interconnected to the sidewall portion by a pair of scalloped ledges. The sidewall portion of the tray includes two side panels each including stiffening ribs extending only along a portion thereof, but not extending along an entire length thereof. The tray is configured such that, in response to a compressing force applied to the tray in a direction substantially perpendicular to the first and second side panels, the sidewall portion of the tray deflects in a direction away from the food items.

14 Claims, 8 Drawing Sheets

Related U.S. Application Data continuation of application No. 17/268,442, filed as application No. PCT/US2019/045848 on Aug. 9, 2019, now Pat. No. 11,254,466.

(60) Provisional application No. 62/720,801, filed on Aug. 21, 2018.

(58) Field of Classification Search
USPC ..... 206/564
See application file for complete search history.

(56) References Cited

U.S. PATENT DOCUMENTS

| | | | |
|---|---|---|---|
| 3,128,030 | A | 4/1964 | Davies |
| D200,178 | S | 1/1965 | Barnes |
| D201,579 | S | 7/1965 | Weiss |
| D204,323 | S | 4/1966 | Bostrom |
| D204,505 | S | 4/1966 | Bostrom |
| 3,322,267 | A | 5/1967 | Weiss |
| 3,372,812 | A | 3/1968 | Parcels |
| D215,823 | S | 11/1969 | Bridgford |
| 3,651,930 | A | 3/1972 | Artz |
| 3,662,943 | A | 5/1972 | Donaldson |
| 3,740,238 | A | 6/1973 | Graham |
| D227,860 | S | 7/1973 | Schumann |
| D228,543 | S | 10/1973 | Jansen |
| 3,937,389 | A | 2/1976 | Wind |
| 4,026,457 | A | 5/1977 | Schubert |
| 4,081,646 | A | 3/1978 | Goltsos |
| 4,192,443 | A | 3/1980 | McLaren |
| 4,202,465 | A | 5/1980 | McLaren |
| D281,229 | S | 11/1985 | Tyler |
| 4,568,017 | A | 2/1986 | Grunert |
| 4,576,330 | A | 3/1986 | Schepp |
| 4,771,934 | A | 9/1988 | Kalmanides |
| D303,354 | S | 9/1989 | Catacchio |
| 4,905,889 | A | 3/1990 | Schuster |
| 5,119,940 | A | 6/1992 | Grindrod |
| 5,162,126 | A | 11/1992 | Hans-Heinz |
| 5,318,810 | A | 6/1994 | Nissel |
| 5,318,811 | A | 6/1994 | Nissel |
| 5,375,701 | A | 12/1994 | Hustad |
| 5,460,843 | A | 10/1995 | Greene |
| D370,345 | S | 6/1996 | Wolff |
| D387,558 | S | 12/1997 | Mann |
| D398,227 | S | 9/1998 | Orkisz |
| D398,525 | S | 9/1998 | Orkisz |
| 6,149,006 | A | 11/2000 | Brauner |
| D510,804 | S | 10/2005 | Horman |
| 7,017,774 | B2 | 3/2006 | Haedt |
| 7,597,206 | B2 | 10/2009 | Atkins |
| D604,604 | S | 11/2009 | Strange |
| D616,250 | S | 5/2010 | Peyton |
| D620,350 | S | 7/2010 | Hernandez |
| 7,857,136 | B2 | 12/2010 | Sielski |
| 8,083,089 | B2 | 12/2011 | Vovan |
| 8,083,093 | B2 | 12/2011 | McCumber |
| 8,231,954 | B2 | 7/2012 | Li |
| D665,273 | S | 8/2012 | Castelletti |
| 8,445,604 | B2 | 5/2013 | Li |
| 8,469,217 | B2 | 6/2013 | Gingras |
| 8,584,881 | B2 | 11/2013 | Rodriguez |
| D701,418 | S | 3/2014 | Tingley |
| 8,672,166 | B2 | 3/2014 | Nazareth |
| 8,746,260 | B2 | 6/2014 | Hewitt |
| 8,876,515 | B2 | 11/2014 | Kohl |
| 9,150,342 | B2 | 10/2015 | Sierra-Gomez |
| D746,675 | S | 1/2016 | Astorga |
| D747,962 | S | 1/2016 | Astorga |
| D758,850 | S | 6/2016 | Dibnah |
| 10,011,415 | B1 | 7/2018 | Bergeron |
| 11,085,687 | B2 | 8/2021 | Leal |
| 11,254,466 | B2 | 2/2022 | Evans |
| 11,724,855 | B2 * | 8/2023 | Evans ..... B65D 5/503 206/564 |
| 2005/0029258 | A1 | 2/2005 | Juliano |
| 2007/0065545 | A1 | 3/2007 | Vovan |
| 2007/0138046 | A1 | 6/2007 | Vovan |
| 2007/0196541 | A1 | 8/2007 | Vovan |
| 2008/0063759 | A1 | 3/2008 | Raymond |
| 2008/0078686 | A1 | 4/2008 | Vovan |
| 2008/0116098 | A1 | 5/2008 | Marooflan |
| 2008/0160143 | A1 | 7/2008 | Edwards |
| 2010/0264151 | A1 | 10/2010 | Reddy-Wynn |
| 2010/0307116 | A1 | 12/2010 | Fisher |
| 2011/0253587 | A1 | 10/2011 | Pinkstone |
| 2013/0015096 | A1 | 1/2013 | Bevier |
| 2014/0054292 | A1 | 2/2014 | Wallce |
| 2014/0099409 | A1 | 4/2014 | Cassens |
| 2014/0287103 | A1 | 9/2014 | Northover |
| 2015/0129594 | A1 | 5/2015 | Exner |
| 2015/0232262 | A1 | 8/2015 | Taylor |
| 2015/0307257 | A1 | 10/2015 | Padda |
| 2015/0360840 | A1 | 12/2015 | Tilahun |
| 2016/0096674 | A1 | 4/2016 | Parsons |
| 2016/0176554 | A1 | 6/2016 | Blake |
| 2017/0001786 | A1 | 1/2017 | Wallace |
| 2017/0043942 | A1 | 2/2017 | Brown |
| 2017/0088297 | A1 | 3/2017 | Barton |
| 2017/0121089 | A1 | 5/2017 | Gillblad |
| 2019/0241354 | A1 | 8/2019 | Corbin |

FOREIGN PATENT DOCUMENTS

| | | |
|---|---|---|
| EP | 0994021 | 4/2000 |
| EP | 1006056 | 6/2000 |
| EP | 1348640 | 10/2003 |
| EP | 1445199 | 8/2004 |
| EP | 1526093 | 4/2005 |
| EP | 1789490 | 5/2007 |
| EP | 1838586 | 10/2007 |
| EP | 1997618 | 12/2008 |
| EP | 2298668 | 3/2011 |
| EP | 2354036 | 8/2011 |
| EP | 2361759 | 8/2011 |
| EP | 2660166 | 11/2013 |
| EP | 2905240 | 8/2015 |
| EP | 3215363 B1 | 9/2017 |
| EP | 3268292 | 1/2018 |
| EP | 3279112 | 2/2018 |
| EP | 2822872 B1 | 5/2018 |
| EP | 2870079 B1 | 1/2021 |
| EP | 3204314 B1 | 1/2021 |
| WO | 2011042921 | 4/2011 |
| WO | 2015119155 | 8/2015 |
| WO | 2016207587 | 12/2016 |
| WO | 2017027918 | 2/2017 |
| WO | 2018004558 | 1/2018 |

OTHER PUBLICATIONS

International Search Report and Written Opinion, International Patent Application No. PCT/US2019/045848, date of mailing Dec. 9, 2019 (10 pgs.).

* cited by examiner

FOOD STORAGE TRAY

CROSS REFERENCE TO RELATED APPLICATIONS

This application is a continuation of U.S. application Ser. No. 17/590,309, filed Feb. 1, 2022, which is a continuation of U.S. application Ser. No. 17/268,442, filed Feb. 12, 2021, now U.S. Pat. No. 11,254,466, which is a U.S. national phase application of Int. App. No. PCT/US2019/045848, filed Aug. 9, 2019, which claims the benefit of U.S. provisional App. No. 62/720,801, filed Aug. 21, 2018, each of which is hereby incorporated herein by reference in its entirety.

BACKGROUND

Individual food items such as cookies, crackers, and the like are often stored in multi-compartment trays where each compartment stores stacks of cookies or crackers. Such trays are typically constructed from a thin polymer material and are susceptible to deformation due to compressive forces that may be applied to the trays during manufacturing, packaging and/or transportation of the trays. For example, during packaging, the cookie trays may abut against each other while moving on a conveyor such that compressive forces may be applied against some of the trays by adjacent trays. Such compressive forces may lead to the buckling of the trays and/or the deformation/distortion of the individual compartments or compartments that retail the cookies. Such deformation/distortion is undesirable, since it may result in damage (e.g., cracking, breaking, etc.) to the food items stored therein, rendering such trays unusable for sale to consumers.

SUMMARY

A tray for retaining a plurality of items, such as food items, includes a plurality of compartments separated by one or more dividers. The tray includes a bottom wall portion, a sidewall portion extending upwardly from the bottom wall portion, and the one or more dividers. The bottom wall portion, the sidewall portion and the one or more dividers together define a plurality of interconnected compartments each configured to retain a stack of the food items accessible via an opening, opposite the bottom wall portion. A flange portion is disposed about the opening and at an opposite end of the sidewall portion relative to the bottom wall portion. The flange portion includes a peripheral rim extending outwardly from the sidewall portion. Each of the one or more dividers separates adjacent compartments from each other. The one or more dividers each extend upwardly from the bottom wall portion and terminate adjacent the peripheral rim. Each of the dividers has a pair of opposing divider walls positioned at an angle relative to each other and joined at an apex. Each of the one or more dividers is connected to the peripheral rim by a pair of scalloped ledges, one at each end of the divider. The sidewall portion includes a pair of opposing end walls each having stiffening ribs extending from adjacent the bottom portion toward the flange portion and spaced from the flange portion by a segment of the end wall. In response to a compressing force in a direction substantially perpendicular to the end walls, the angle between the divider walls of each of the one or more dividers increases compared to when there is no compressing force.

In some embodiments, each of the end walls includes a non-corrugated portion not including the stiffening ribs, with the non-corrugated portion extending from distal ends of the stiffening ribs to the peripheral rim. In one aspect, each of the two side panels includes a curved portion including the stiffening ribs and a straight non-corrugated portion not including the stiffening ribs.

If the tray includes three compartments, then the bottom wall portion includes a first bottom panel, a second bottom panel, and a third bottom panel, and each of the first, second, and third bottom panels are generally rectangular and planar and do not include any of the stiffening ribs. If the tray includes four compartments, then four such bottom panels can be included.

In some aspects, each of the compartments of the tray includes a front panel and a rear panel not including the stiffening ribs, and at least one side panel including the stiffening ribs extending along an entire length thereof. In some embodiments, each of the first and second dividers includes two interconnected side panels including the stiffening ribs extending along the entire length thereof.

The peripheral rim may include an upwardly-facing surface having an inner edge intersecting with the sidewall portion and an outer edge intersecting with the raised perimeter. The outer flange may include an upwardly facing surface having an inner edge intersecting with the raised perimeter and a free outer edge. The upwardly-facing surface of the peripheral rim may include a plurality of downwardly-extending protrusions that are configured to rest on the peripheral rim of a second tray when the second tray is stacked on top of the tray. The downwardly-extending protrusions are sized such that the peripheral rims of each in the stack are spaced to facilitate denesting of trays from the stack.

In some embodiments, a substantially horizontal upwardly-facing portion of each of the scalloped ledges comprises a strengthening rib extending inwardly from the sidewall portion. Each of the scalloped ledges may be interconnected with a respective one of the first and second dividers by the strengthening rib. A substantially vertical inwardly-facing portion of each of the scalloped ledges may extend upwardly from the strengthening rib along the sidewall portion and terminates at the peripheral edge.

The tray may be made of at least one material including, but not limited to: general purpose polystyrene (PS), high impact polystyrene (HIPS), polyethylene terephthalate (PET), recycled polyethylene terephthalate (RPET), polyvinyl chloride (PVC), polypropylene (PP), high density polyethylene (HDPE), propylene ethylene copolymers, foamed polymer(s), paperboard and combinations thereof. The compartments of the tray may be shaped to each retain a plurality of substantially circular food items.

DETAILED DESCRIPTION

Figure 1:
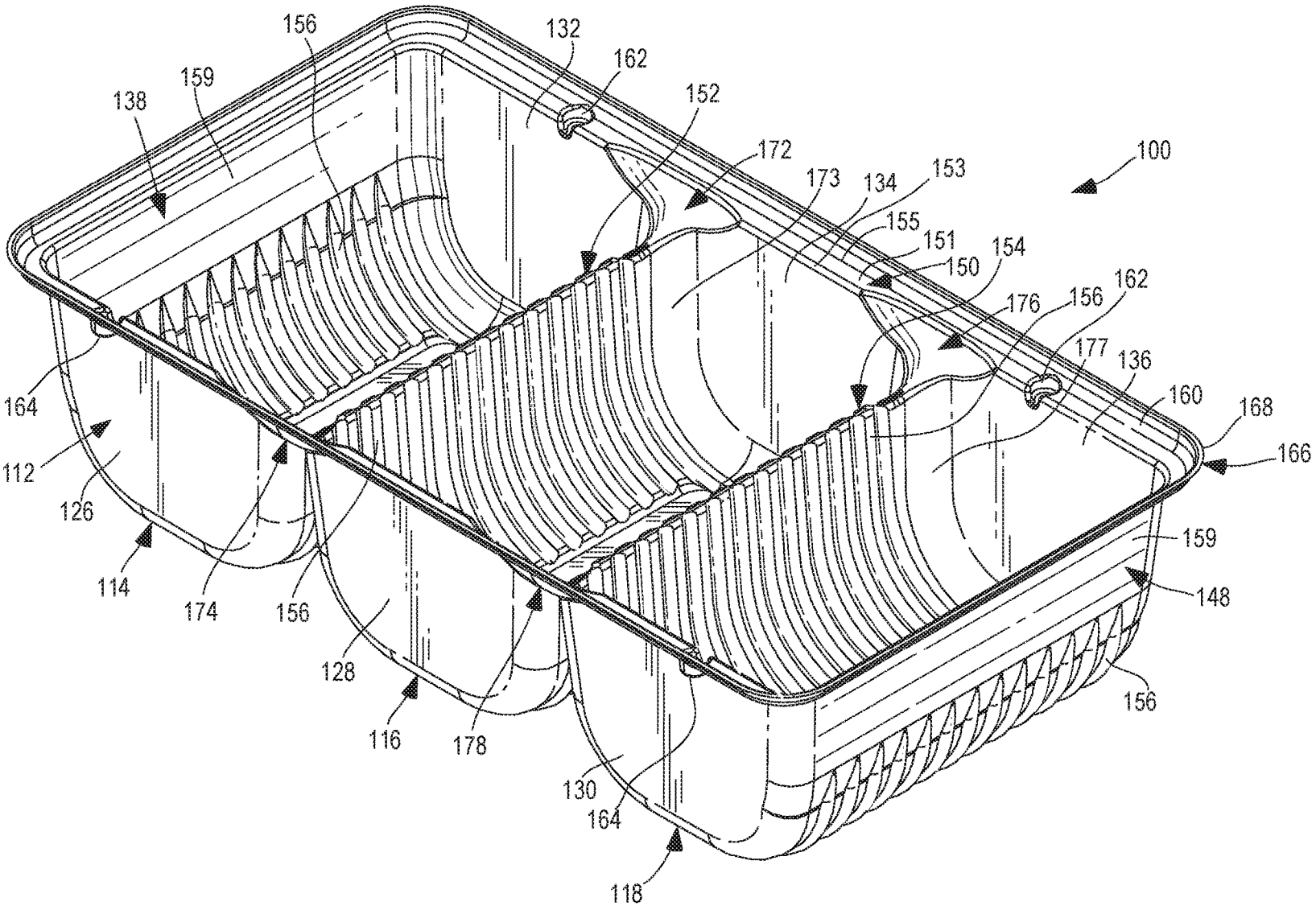
FIG. 1 is a perspective view of a food storage tray depicting an embodiment having three compartments and showing a bottom wall, an upstanding sidewall and a peripheral flange portion surrounding an opening of the tray.
Figure 2:
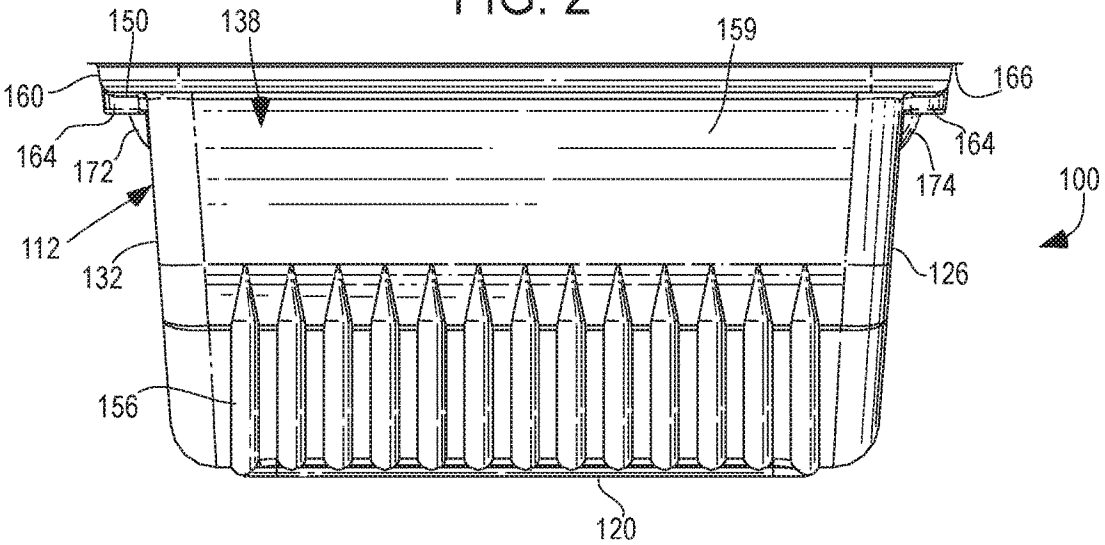
FIG. 2 is a front elevation view of the food storage tray of FIG. 1, showing ribs that are spaced from the peripheral flange portion by a segment of the sidewall.

FIG. 1 shows an exemplary embodiment of a tray 100 for retaining generally circular food items 90. Exemplary food items 90 that may be retained in the tray 100 may include, but are not limited to, cookies, crackers, and the like.

The tray 100 has a one-piece construction, and may be thermoformed, injection-molded, blow-molded, or the like. In some embodiments, the tray 100 is made from one or more polymer-based materials, and includes one or more polymers, co-polymers, and/or plastic materials. For example, the tray 100 may be constructed from general purpose polystyrene (PS), high impact polystyrene (HIPS), polyethylene terephthalate (PET), recycled polyethylene terephthalate (RPET), polyvinyl chloride (PVC), polypropylene (PP), high density polyethylene (HDPE), propylene ethylene copolymers, foamed polymer(s), paperboard and the like, or combinations thereof. While the tray 100 has been illustrated in the accompanying drawing figures as being made of a material that is not transparent, it will be appreciated that the tray 100 may be made to be transparent, such that portions of the food items 90 (indicated in dotted lines in FIG. 3) retained in the tray 100 would be visible through the sidewalls of the tray 100.

Figure 3:
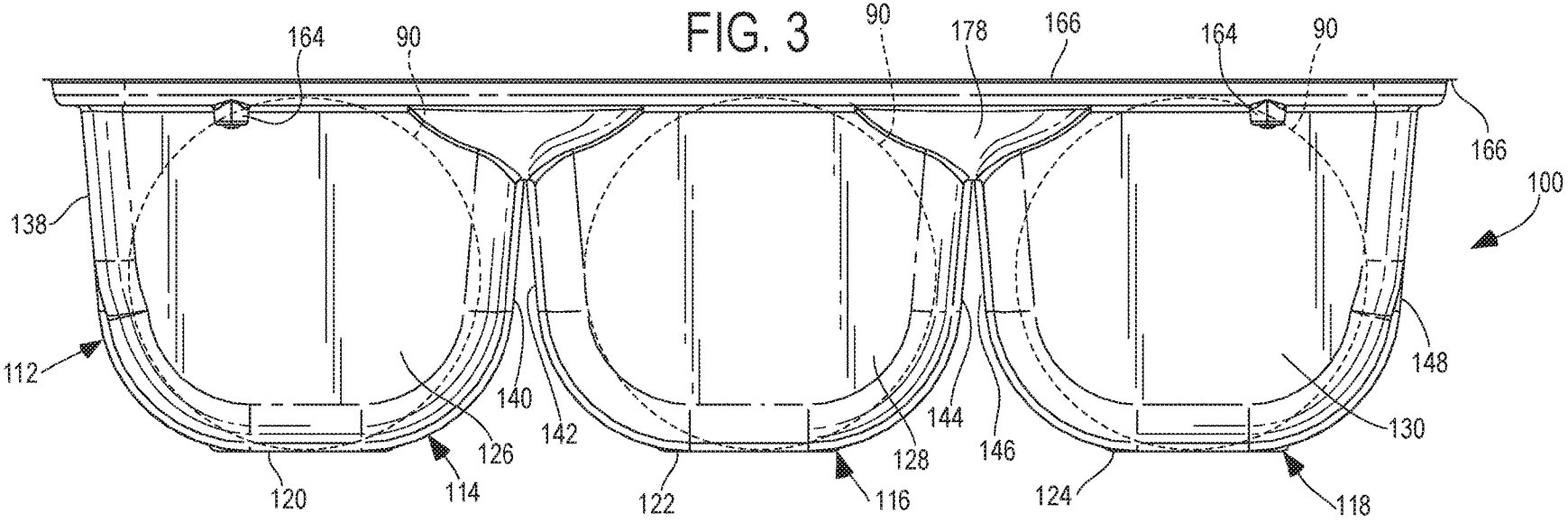
FIG. 3 is a side elevation view of the food storage tray of FIG. 1, showing cookies received in the compartments of the tray.

With reference to FIGS. 1 and 3, the tray 100 includes a first bottom panel 120, a second bottom panel 122, and a third bottom panel 124. In some embodiments, the first, second, and third bottom panels 120, 122, and 124 are each generally rectangular in shape, are planar, and do not include any of the stiffening ribs, discussed in more detail below, that are formed in some of the panels of the sidewall portion 112 of the tray 100. As can be seen in FIG. 3, each of the bottom panels 120, 122, 124 is substantially straight and oriented in a horizontal plane in order to permit the tray 100 to stably sit on a flat support surface such as a shelf or a table when the bottom panels 120, 122, 124 are in contact with the flat support surface.

The sidewall portion of the exemplary tray 100 illustrated in FIGS. 1 and 3 includes a first front panel 126, a second front panel 128, a third front panel 130, a first rear panel 132, a second rear panel 134, a third rear panel 136, first side panels 138, 142, and 146, and second side panels 140, 144, and 148. Three compartments 114, 116, 118 are defined in party by these panels, with the compartments 114, 116 and 118 each sized and shaped to retain a plurality of food items 90 therein.

The first compartment 114 of the exemplary tray 100 includes a bottom panel 120, a front panel 126, a rear panel 132 opposite the front panel 126, a first side panel 138, and a second side panel 140 opposite the first side panel 138. The second compartment 116 of the exemplary tray 100 includes a bottom panel 122, a front panel 128, a rear panel 134 opposite the front panel 128, a first side panel 142, and a second side panel 144 opposite the first side panel 142. The third compartment 118 of the exemplary tray 100 includes a bottom panel 124, a front panel 130, a rear panel 136 opposite the front panel 130, a first side panel 146, and a second side panel 148 opposite the first side panel 146. In the illustrated embodiment, the compartments 114, 116, and 118 are shaped to retain a plurality of substantially circular food items 90 arranged in stacks therein.

The compartments 114, 116, 118 may be sized and shaped to accommodate various typically commercially available substantially circular cookies, crackers, or the like having a diameter from about 2.4 to about 2.6 inches and, in some examples, a diameter of about 2.5 inches. The compartments 114, 116, 118 may be all identical in size, or may be of different sizes. For example, in some embodiments, each of the compartments 114, 116, 118 may have a diameter from about 2.4 to about 2.6 inches. In one aspect, the second compartment 116 has a diameter of about 2.469 inches, and the first and third compartments 114 and 118 each have a diameter of about 2.413 inches. It will be appreciated that the tray 100 and the compartments 114, 116, and 118 are not drawn to scale, and that the compartments 114, 116, 118 of the tray 100 may be configured to have various dimensions suitable to retain various commercially available substantially circular food items 90.

With reference to FIG. 1, the front panel 126, the rear panel 132, and the first side panel 138 of the first compartment 114 extend upwardly from the bottom panel 120 to a peripheral rim 150. The second side panel 140 of the first compartment 114 also extends upwardly from the bottom panel 120, but terminates at a height that is below the peripheral rim 150. The front panel 128 and the rear panel 134 of the second compartment 116 extend upwardly from the bottom panel 122 to the peripheral rim 150. The first side panel 142 and the second side panel 144 of the second compartment 116 also extend upwardly from the bottom panel 122, but terminate at a height that is below the peripheral rim 150. The front panel 130, the rear panel 136, and the second side panel 148 of the third compartment 118 extend upwardly from the bottom panel 124 to the peripheral rim 150. The first side panel 146 of the third compartment 118 also extends upwardly from the bottom panel 124, but terminates at a height that is below the peripheral rim 150.

As can be seen with reference to FIGS. 1 and 3, the second side panel 140 of the first compartment 114 and the first side panel 142 of the second compartment 116 are attached to one another and together form a first divider 152 that separates the interior of the first compartment 114 from the interior of the second compartment 116. Similarly, the second side panel 144 of the second compartment 116 and the first side panel 146 of the third compartment 118 are attached to one another and together form a second divider 154 that separates the interior of the second compartment 116 from the interior of the third compartment 118. In other words, the first divider 152 is formed by two interconnected side panels 140 and 142 each having stiffening ribs 156 extending along an entire length thereof, and the second divider 154 is formed by two interconnected side panels 144 and 146 each having stiffening ribs 156 extending along an entire length thereof.

With reference to FIG. 3, each of the first side panels 138, 142, and 146, as well as each of the second side panels 140, 144, and 148 are generally curvilinear in shape and may be entirely curved along their entire lengths, or may include both a curved portion and a straight portion along their lengths. The second panel 140 of the first compartment 114, the first panel 142 and the second panel 144 of the second compartment 116, and the first side panel 146 of the third compartment 118 each include a plurality of interconnected stiffening ribs 156 that provide the panels 140, 142, 144, and 146 with a corrugated appearance along their entire lengths. While in the illustrated embodiment, the second panel 140 of the first compartment 114, the first panel 142 and the second panel 144 of the second compartment 116, and the first side panel 146 of the third compartment 118 each include thirteen stiffening ribs 156, it will be appreciated that the number of ribs has been illustrated by way of example only, and the number of ribs may be varied depending on the size of the tray and/or the size of the stiffening ribs 156. In one non-limiting example, the stiffening ribs 156 are oriented and sized such that the distance between the apex of adjacent stiffening ribs 156 is about 0.25 to about 0.26 inches and, more preferably, about 0.255 inches. It will be understood that the ribs can be of cross-sectional shapes other than illustrated, such as v-shaped, rectangular, trapezoidal, concave or convex.

Figure 4:
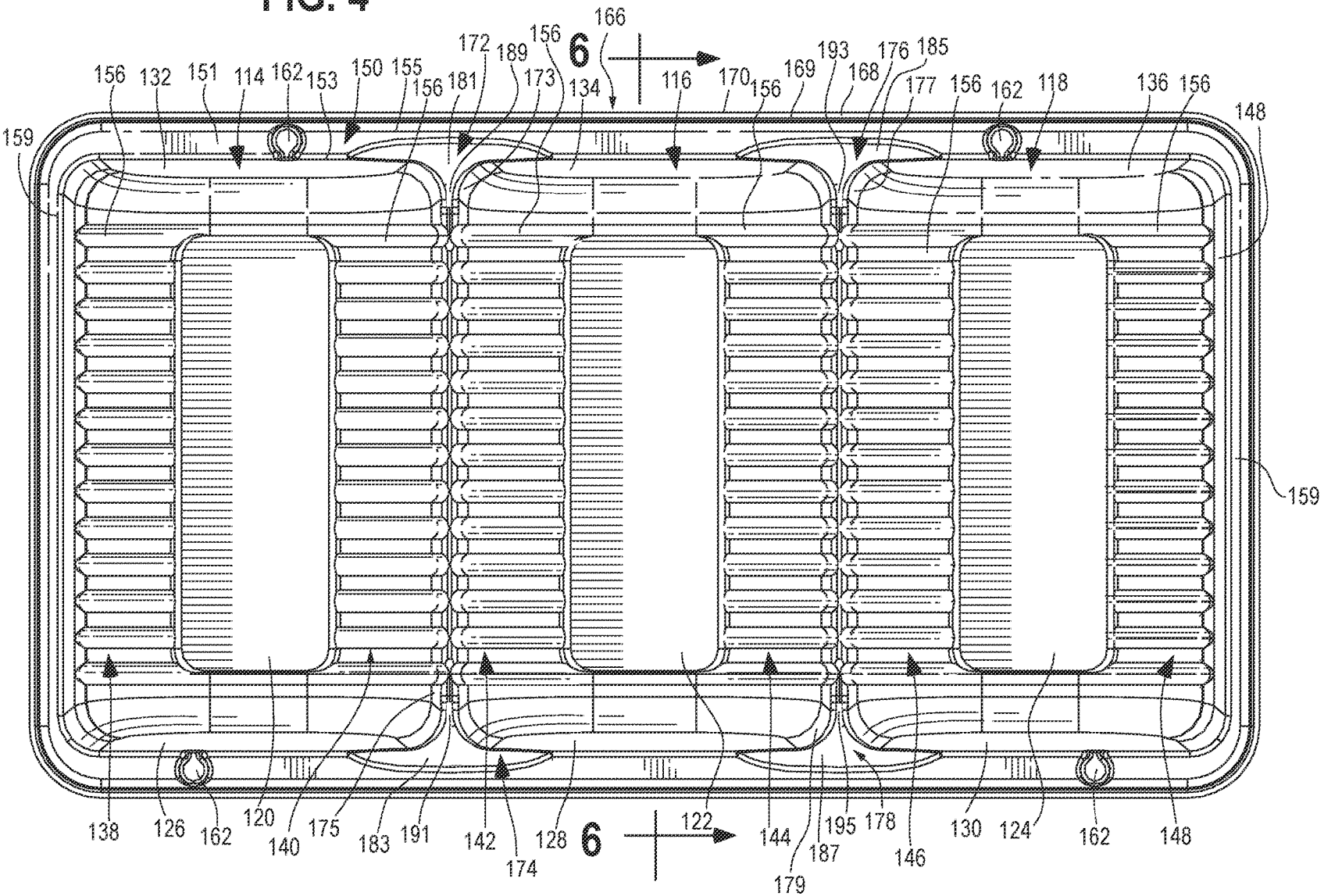
FIG. 4 is a top plan view of the food storage tray of FIG. 1.
Figure 5:
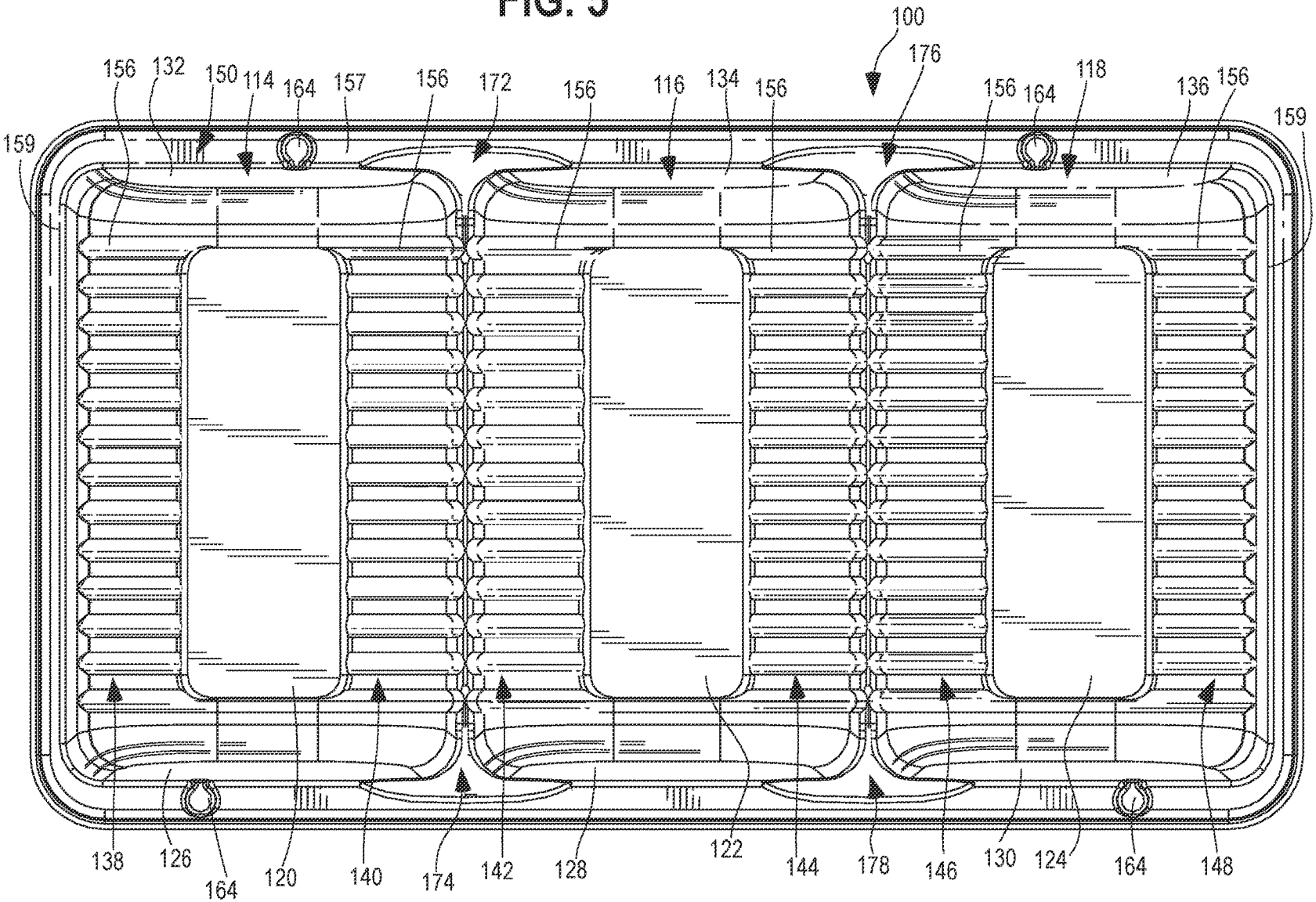
FIG. 5 is a bottom plan view of the food storage tray of FIG. 1.

In the illustrated, non-limiting embodiment, the tray 100 has an overall rectangular shape as can be seen in FIG. 4, and the dimensions of the tray 100 may be from about 8.5 to about 8.6 inches, preferably, from 8.59 to about 8.60 inches along the longer dimension of the tray 100, and from about 4.7 to about 4.8 inches, preferably, from about 4.78 to about 4.79 inches along the shorter dimension of the tray 100. In some aspects, the distance between the front panels 126, 128, 130 and the rear panels 132, 134, 136 is from about 4.1 inches to about 4.2 inches, preferably, about 4.15 inches.

The first panel 138 of the first compartment 114 and the second panel 148 of the third compartment 118 also include a plurality of interconnected stiffening ribs 156 that provide the panels 138 and 148 with a corrugated appearance, but the stiffening ribs 156 do not extend along the entire length of each of the panels 138 and 146, instead extending only along a portion of the length of each of the panels 138 and 146. As such, each of the panels 138 and 148 includes a non-corrugated portion 159 not including any stiffening ribs 156 and not having a corrugated appearance. The non-corrugated portion 159 of each of the panels 138 and 148 adds structural integrity and increased rigidity in certain directions, such as parallel to a central axis of the ribs, to the tray 100, advantageously making the tray 100 less susceptible to undesired deformation during manufacturing, packaging, transportation, sorting, or the like, as well as contributing to stability.

Figure 7:
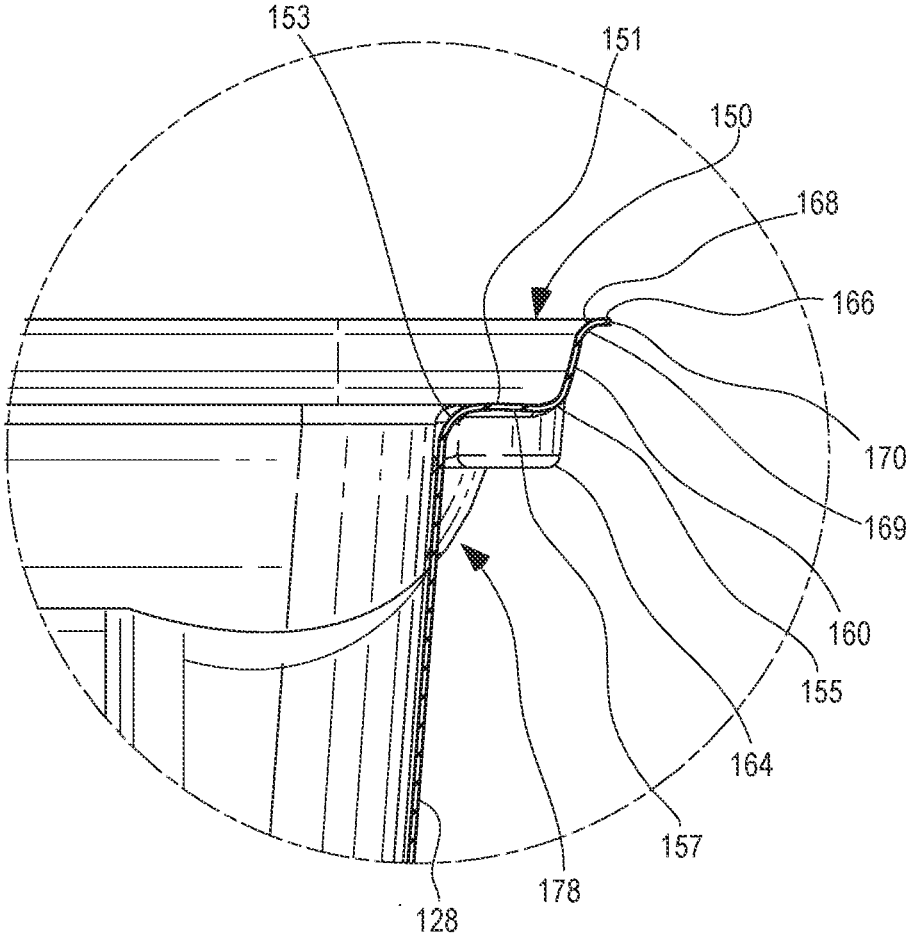
FIG. 7 is a close-up view of the peripheral flange portion of FIG. 6.

With reference to FIG. 1, the peripheral rim 150 of the tray 100 surrounds the interior of the three compartments 114, 116, 118, and includes an upwardly-facing surface 151 having an inner edge 153 intersecting the sidewall portion and an outer edge 155 intersecting a raised perimeter portion 160. The peripheral rim 150 also includes a downwardly-facing surface 157. In the illustrated embodiment, the tray 100 includes a raised perimeter portion 160 extending upwardly from the outer edge 155 of the upwardly-facing surface 151 of the peripheral rim 150. The exemplary tray 100 further includes an outer flange 166 extending outwardly from the raised perimeter portion 160 of the peripheral rim 150. The outer flange 166 includes an upwardly-facing surface 168 having an inner edge 169 intersecting the raised perimeter portion 160 and terminating in a free edge 170 that extends outwardly in a direction away from the raised perimeter portion 160 of the peripheral rim 150, as shown in the view of FIG. 7.

As can be seen in FIG. 4, the width of the outer flange 166 is significantly smaller than the width of the peripheral rim 150. For example, in some embodiments, the width of the peripheral rim 150, as measured from an intersection of the sidewall portion 112 with the peripheral rim 150 to an intersection of the peripheral rim 150 and the raised perimeter portion 160, is from about 0.24 to about 0.26 inches, more preferably, about 0.25 inches. By comparison, the width of the outer flange 166, as measured from an intersection of the raised perimeter portion 160 and the outer flange 166 to the free edge 170, is from about 0.06 to about 0.07 inches, more preferably, about 0.063 inches. In some embodiments, the height of the raised perimeter portion 160, as measured from the intersection of the raised perimeter portion 160 with the upwardly-facing surface 151 of the peripheral rim 150 to the intersection of the raised perimeter portion 160 with the outer flange 166, is from about 0.1 inches to about 0.2 inches, more preferably, from about 0.12 to about 0.13 inches. It will be appreciated that these dimensions are provided by way of example only, and that the tray 100 may have dimensions that are outside of these exemplary values, if suitable for differently sized (e.g., smaller or larger) food items 90.

In some implementations, portions of another tray complementary to the tray 100 may come in contact with portions of the upwardly-facing surface 151 of the peripheral rim 150 and/or portions of the raised perimeter portion 160 and/or portions of the upwardly-facing surface 168 of the outer flange 166 when the other (i.e., second) tray is stacked on top of the illustrated tray 100. In the embodiment illustrated in FIG. 1, to facilitate the stacking of another tray on top of the tray 100, the tray 100 includes a plurality of depressions 162 (when viewed from the top) that form protrusions 164 (when viewed from the side or bottom of the tray The protrusions may have a diameter from about 0.2 to about 0.3 inches, more preferably, from about 0.21 to about 0.22 inches. The protrusions 164, extending downwardly from the downward-facing surface 157 of the peripheral rim 150, may have a length of about 0.1 to about 0.2 inches, more preferably, from about 0.11 to about 0.12 inches. Preferably, though not necessarily, four protrusions 164 are provided, with two each being disposed on opposing sides of the peripheral rim 150. The spacing of the protrusions 164, regardless of number, is different on each side. Different molds can be used to produce trays with different positions of the protrusions 164, for example. The purpose of the protrusions 164 is to have adjacent trays 100 in a stack slightly spaced at their peripheral rims 150 so that the peripheral rims 150 are not directly engaged, but rather the protrusions 164 of an upper tray will rest on the peripheral rim 150 of a lower tray for purpose of facilitating denesting of trays from a stack of trays.

In the illustrated embodiment, the first divider 152 is interconnected with the peripheral rim 150 by two scalloped ledges 172, 174, while the second divider 154 is interconnected with the peripheral rim 150 by two scalloped ledges 176, 178. The scalloped ledges can resemble a truncated gingko leaf or a (non-mathematical) hyperbolic shape. Indeed, a portion of the scalloped ledges protrudes beyond the adjacent side walls, as shown in FIG. 7, and into the flange portion, as shown in FIG. 4. The scalloped ledges function to allow for flexing of the compartments away from each other when end walls of the tray are subjected to compressing forces by pivoting about apexes of the dividers, such that opposing divider walls can move away from each other, e.g., the angle between opposing divider walls (e.g., 140, 142) increases.

A portion of each of the scalloped ledges 172, 174, 176, 178 forms an upper portion of an end portion 173, 175, 177, 179, respectively, of the dividers. As can be seen, for example, in FIG. 4, the end portion 173 extends inwardly from an interior surface of the rear panels 132 and 134, the end portion 175 extends inwardly from an interior surface of the front panels 126 and 128, the end portion 177 extends inwardly from an interior surface of the rear panels 134 and 136, and the strengthening rib 179 extends inwardly from an interior surface of the front panels 128 and 130. The end portions of the dividers can lack ribs or corrugation, such that they can be more likely to flex, particularly at their intersection with the adjacent side walls, as compared to in the middle segment of the dividers.

Figure 6:
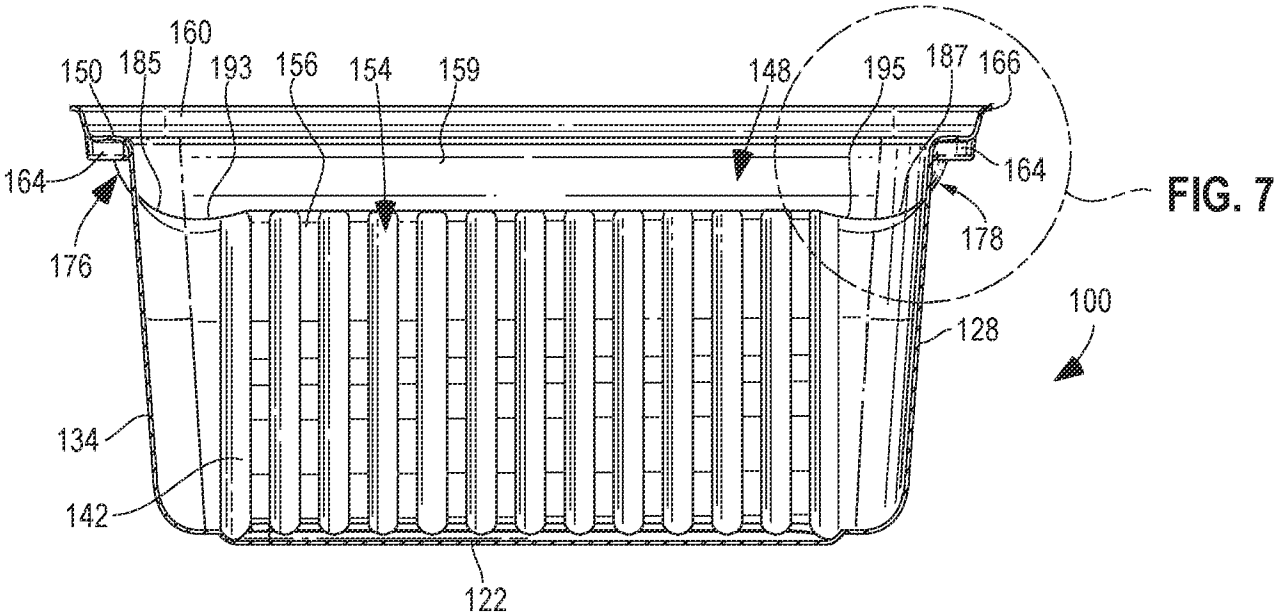
FIG. 6 is a cross-sectional view of the food storage tray of FIG. 1 taken along line 6-6 of FIG. 4.

In the illustrated embodiment, each of the scalloped ledges 172, 174, 176, and 178 includes an inclined inwardly-facing portion 181, 183, 185, 187, respectively, as well as a substantially horizontal upwardly-facing portion 189, 191, 193, 195, respectively, as can be seen, for example, in FIGS. 1, 4, and 6. With reference to FIG. 1, each of the inclined inwardly-facing portions 181, 183, 185, 187 of the respective scalloped ledges 172, 174, 176, and 178 extends upwardly from their respective substantially horizontal upwardly-facing portions 189, 191, 193, 195 along the sidewall portion 112 and terminates at the peripheral rim 150. With reference to FIGS. 1 and 6, the substantially horizontal upwardly-facing portions 189, 191, 193, 195 each form an upper-most surface of their respective strengthening ribs 173, 175, 177, 179, which in turn interconnect their respective scalloped ledges 172, 174, 176, and 178 to a respective one of the first and second dividers 152 and 154.

In the illustrated embodiment, the second side panel 140 of the first compartment 114 and the first side panel 142 of the second compartment 116 are oriented such that they diverge from each other as they extend downwardly from their respective scalloped ledges 172 and 174 and in a direction toward the bottom panels 120 and 122 of their respective compartments 114 and 116. In some embodiments, the angle between the initially diverging and substantially straight portions of the second side panel 140 of the first compartment 114 and the first side panel 142 of the second compartment 116 is about 10°. Similarly, the second side panel 144 of the second compartment 116 and the first side panel 146 of the third compartment 118 are oriented such that they diverge from each other as they extend downwardly from their respective scalloped ledges 176 and 178 and in a direction toward the bottom panels 122 and 124 of their respective compartments 116 and 118.

With reference to FIG. 3, the second side panel 140 of the first compartment 114 and the first side panel 142 of the second compartment 116 are oriented such that they diverge from each other as they extend downwardly from their respective scalloped ledges 172 and 174 and in a direction toward the bottom panels 120 and 122 of their respective compartments 114 and 116. In some embodiments, the angle between the initially diverging and substantially straight portions of the second side panel 140 of the first compartment 114 and the first side panel 142 of the second compartment 116 is about 10°. Similarly, the second side panel 144 of the second compartment 116 and the first side panel 146 of the third compartment 118 are oriented such that they diverge from each other as they extend downwardly from their respective scalloped ledges 176 and 178 and in a direction toward the bottom panels 122 and 124 of their respective compartments 116 and 118. In some embodiments, the angle between the initially diverging and substantially straight portions of the second side panel 144 of the second compartment 116 and the first side panel 146 of the third compartment 118 is about 10°. The first side panel 138 of the first compartment 114 and the second side panel 148 of the third compartment 118 are oriented such that they converge toward each other as they extend downwardly from their respective portions of the peripheral rim 150 and in a direction toward the bottom panels 120 and 124 of their respective compartments 114 and 118. In some embodiments, the angle between the substantially straight portion of the first side panel 138 of the first compartment 114 is about 5° relative to a vertical plane perpendicular to the peripheral rim 150. Similarly, in some embodiments, the angle between the substantially straight portion of the second side panel 148 of the third compartment 118 is about 5° relative to a vertical plane perpendicular to the peripheral rim 150.

The scalloped ledges 172, 174, 176, and 178 together with their respective strengthening ribs 173, 175, 177, and 179 are believed to advantageously provide the tray 100 with greater structural rigidity, thereby restricting and/or preventing undesired deformation/distortion of the sidewall portion 112 of the tray 100 and/or of the compartments 114, 116, 118 during manufacturing, packaging, transportation, or the like, thus reducing and/or eliminating the damage to the food items 90 that would have otherwise resulted from such undesired deformation or distortion of the compartments 114, 116, 118 inward towards the food items 90.

Generally speaking, and without wishing to be limited by theory, there are several structural features that are believed to contribute to the undesired buckling of conventional cookie trays. First, in some conventional cookie trays, the stiffening ribs formed in the outermost sidewall panels of the tray extend along the entire length of the sidewall panels or end walls and extend into the peripheral rim, creating a natural weakened location for the outermost sidewall panels to buckle and/or kink, leading to the inwardly-directed deformation of the food item-containing compartments. In addition, in conventional trays, the transitions between the dividers and the sidewall are so robust in terms of their height and width that they undesirably create a large footprint on the sidewalls, thereby creating natural bend/kink points around their perimeter that often lead to the inwardly directed deformation of the front and rear panels of the sidewall.

The tray 100 overcomes the inward buckling tendencies of conventional cookie trays by increasing the rigidity of the tray 100 while providing the tray 100 with an increased resistance to buckling in response to outside front, rear, and/or side compression forces that the tray 100 may experience during packaging or transportation. For instance, as discussed above, the tray 100 includes first and second side panels 138 and 148 that have stiffening ribs 156 that do not extend along the entire length of each of the panels 138 and 146, but extend only along a portion of the length of each of the panels 138 and 146, which provides each of the panels 138 and 148 with a non-corrugated portion 159 not including any stiffening ribs 156. The portion 159 of each of the panels 138 and 148 provides a solid, non-corrugated structure to the panels 138 and 148, thereby increasing the structural integrity and increased rigidity to the sidewall portion 112 of the tray 100, advantageously making the tray 100 less susceptible to undesired deformation during manufacturing, packaging, transportation, sorting, or the like. In addition, both the scalloped ledges 172, 174, 176, and 178 and their respective strengthening ribs 173, 175, 177, and 179 have a narrow footprint on the sidewall portion 112 such that they do not create natural areas susceptible to buckling or kinking unlike the conventional trays.

Figure 9:
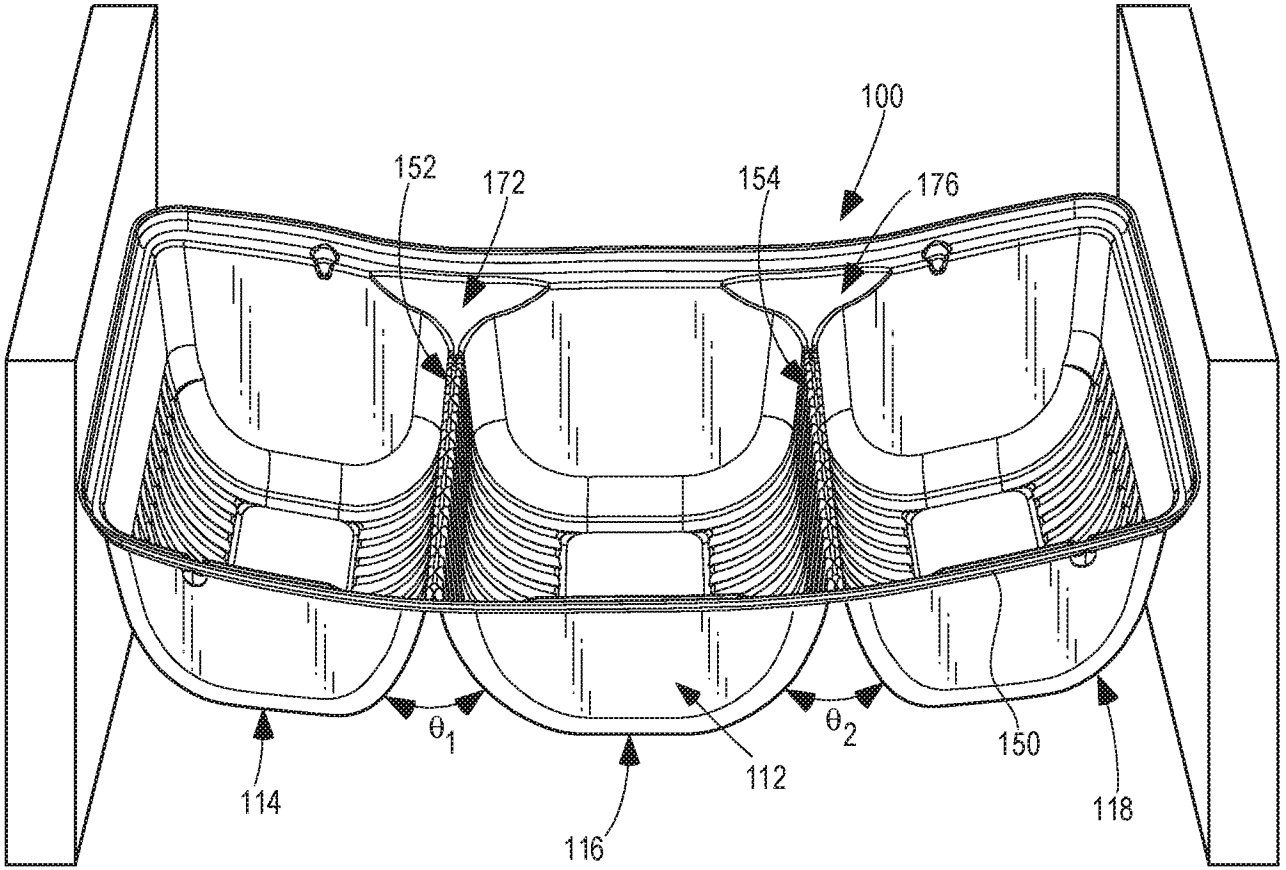
FIG. 9 is a perspective view of the food storage tray of FIG. 1 being subjected to compressing forces on opposing ends and showing the tray bowing.

Without wishing to be limited by theory, the tray 100 according to the embodiments described herein are configured such that, when compressive force is applied to the tray 100 in a direction substantially perpendicular to the first and second side panels 138 and 148, the sidewall portion 112 of the tray 100 deflects in a direction away from the food items 90 (e.g., with the longest dimension of the peripheral rim 150 bowing out in a direction away from the bottom panels 120, 122, 124 and the angles between the walls of adjacent dividers increase (01 and 02) as compared to when there is no compressing force, as shown in FIG. 9, or bowing out in a direction toward the bottom panels 120, 122, 124) such that the sidewall portion 112 does not buckle or kink inwardly into the compartments 114, 116, 118, thereby restricting and/or preventing damage to the food items 90 that often resulted due to the buckling or kinking of the conventional trays.

Figure 8:
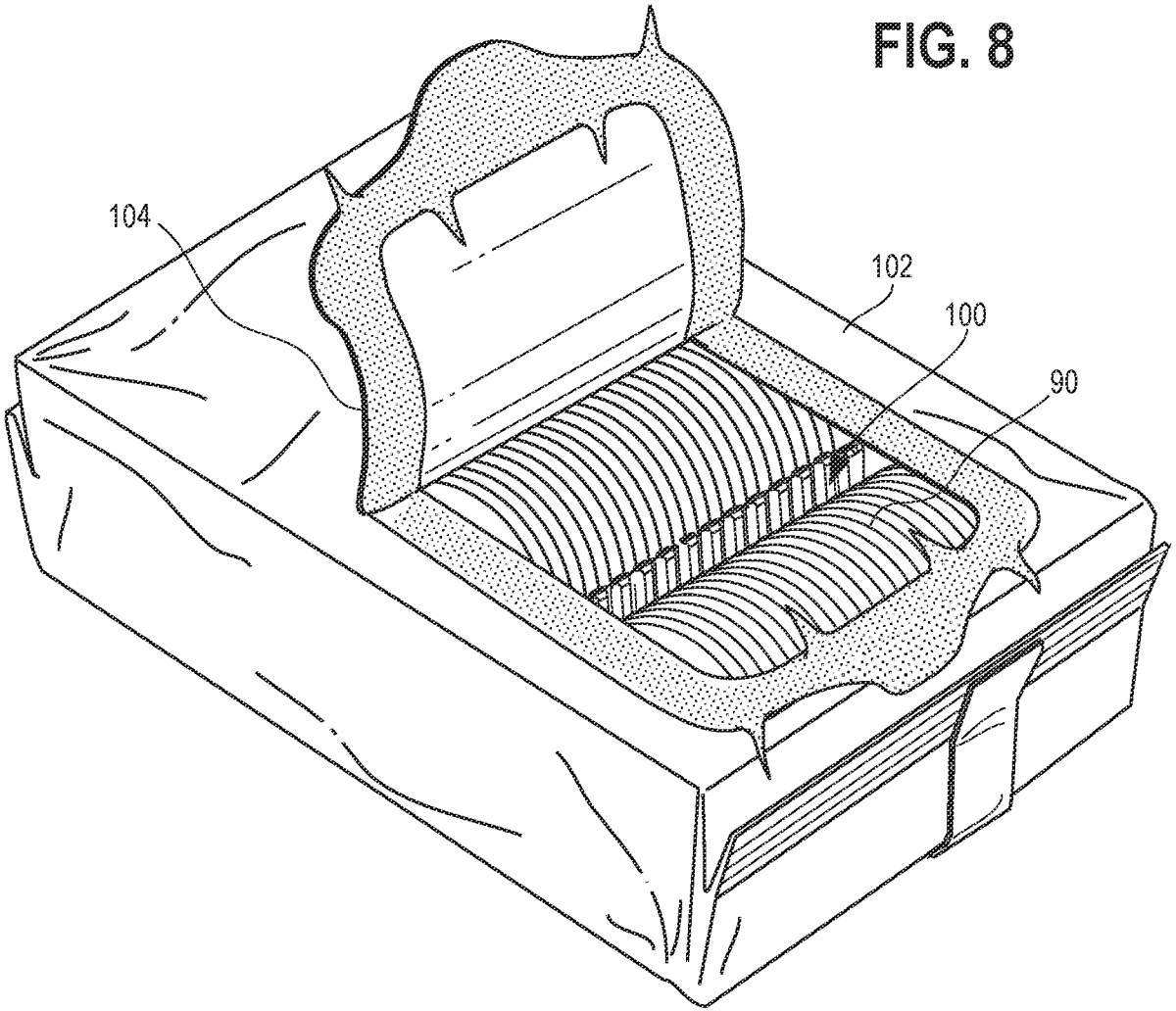
FIG. 8 is a perspective view of the food storage tray of FIG. 1 disposed in an outer surrounding wrapper and containing stacks of cookies, and showing the wrapper having a flap in a partially open position to permit access to the cookies.

The tray 100 can be part of a package, as shown in FIG. 8, and can include an outer surrounding wrapper 102 and a plurality of items, such as cookies 90, disposed in each of the compartments. The wrapper 102 can optionally include a reclosable flap 104, also as shown in FIG. 8.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

The invention claimed is:

1. A tray for retaining a plurality of food items, the tray comprising:

a bottom wall portion, a sidewall portion extending upwardly from the bottom wall portion, and one or more dividers, the bottom wall portion, the sidewall portion and the one or more dividers together defining a plurality of interconnected compartments each configured to retain one or more of the food items accessible via an opening, opposite the bottom wall portion;

a flange portion disposed about the opening and at an opposite end of the sidewall portion relative to the bottom portion, the flange portion including a peripheral rim extending outwardly from the sidewall portion;

each of the one or more dividers separating adjacent compartments from each other, the one or more dividers each extending upwardly from the bottom wall portion and terminating adjacent the peripheral rim, each of the one or more dividers being connected with the peripheral rim by a pair of inclined ledges, each of the dividers having a pair of opposing divider walls positioned at an angle relative to each other and joined at an apex;

wherein a portion of each of the inclined ledges protrudes beyond the opposing divider walls and protrudes into the peripheral rim past an inner edge of the upwardly-facing surface of the peripheral rim;

wherein the sidewall portion includes a pair of opposing end walls each having stiffening ribs extending from adjacent the bottom portion toward the flange portion and spaced from the flange portion by a segment of the end wall; and wherein, in response to a compressing force applied to the peripheral rim in a direction substantially perpendicular to a face of each of the end walls, portions of the divider walls of each of the one or more dividers move in a direction away from each other and increase the angle between the portions of the divider walls of each of the one or more dividers.

2. The tray of claim 1, wherein the tray has three compartments and two dividers, the dividers extending generally parallel to the end walls.

3. The tray of claim 1, wherein each of the end walls includes a curved portion including the stiffening ribs and the segment of each of the end walls includes a planar portion.

4. The tray of claim 2, wherein the bottom wall portion includes a first bottom panel, a second bottom panel, and a third bottom panel, each of the first, second, and third bottom panels being spaced from each other and being generally rectangular and planar.

5. The tray of claim 2, wherein each of the compartments of the tray includes a pair of opposing panels of the sidewall portion, the opposing panels of adjacent compartments being connected via the divider and the inclined ledges.

6. The tray of claim 1, wherein the peripheral rim includes an upwardly-facing surface having an inner edge intersecting with the sidewall portion and an outer edge intersecting with a raised perimeter extending upwardly from the upwardly-facing surface of the peripheral rim.

7. The tray of claim 6, further comprising an outer flange extending outwardly from the raised perimeter of the peripheral rim and including an upwardly facing surface having an inner edge intersecting the raised perimeter of the peripheral rim and a free outer edge.

8. The tray of claim 1, wherein a downwardly-facing surface of the peripheral rim includes a plurality of protrusions configured to support the tray on the peripheral rim of a second tray when the second tray is stacked on top of the tray.

9. The tray of claim 1, wherein a substantially horizontal, upwardly-facing portion of each of the inclined ledges comprises a portion of a strengthening rib.

10. The tray of claim 9, wherein each of the inclined ledges is interconnected with a respective one of the dividers by the strengthening rib.

11. The tray of claim 10, wherein an inclined, inwardly-facing portion of each of the inclined ledges extends upwardly from the horizontal upwardly-facing portion of each of the inclined ledges.

12. The tray of claim 1, wherein the tray comprises at least one of: general purpose polystyrene (PS), high impact polystyrene (HIPS), polyethylene terephthalate (PET), recycled polyethylene terephthalate (RPET), polyvinyl chloride (PVC), polypropylene (PP), high density polyethylene (HDPE), propylene ethylene copolymers, and combinations thereof.

13. The tray of claim 1, wherein the flange portion includes a raised perimeter portion extending upwardly from the peripheral rim, and an outer flange extending outwardly from the raised perimeter portion.

14. The tray of claim 1, in combination with an outer surrounding wrapper and containing a plurality of cookies in each of the compartments.

* * * * *